US011587710B2

(12) United States Patent
Yen et al.

(10) Patent No.: US 11,587,710 B2
(45) Date of Patent: Feb. 21, 2023

(54) INDUCTOR DEVICE

(71) Applicant: Realtek Semiconductor Corporation, Hsinchu (TW)

(72) Inventors: Hsiao-Tsung Yen, Hsinchu (TW); Ka-Un Chan, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 354 days.

(21) Appl. No.: 16/824,753

(22) Filed: Mar. 20, 2020

(65) Prior Publication Data

US 2020/0312512 A1 Oct. 1, 2020

Related U.S. Application Data

(60) Provisional application No. 62/871,263, filed on Jul. 8, 2019, provisional application No. 62/826,286, filed on Mar. 29, 2019.

(30) Foreign Application Priority Data

Dec. 10, 2019 (TW) ..... 108145174

(51) Int. Cl.
*H01F 17/00* (2006.01)
*H01F 27/28* (2006.01)
*H01F 27/29* (2006.01)

(52) U.S. Cl.
CPC ..... *H01F 17/0006* (2013.01); *H01F 27/2828* (2013.01); *H01F 27/29* (2013.01); *H01F 2017/0073* (2013.01)

(58) Field of Classification Search
CPC ..... H01F 2017/0073; H01F 17/0006; H01F 27/2804; H01F 2027/2809;
(Continued)

(56) References Cited

U.S. PATENT DOCUMENTS 5,420,558 A 5/1995 Ito et al.
9,312,060 B2 4/2016 Godoy et al.
(Continued)

FOREIGN PATENT DOCUMENTS

CN 104769687 A 7/2015
CN 108022913 A 5/2018
(Continued)

OTHER PUBLICATIONS

Taiwan Patent Application 108141274 filed Nov. 13, 2019.
(Continued)

*Primary Examiner* — Ryan Johnson
(74) *Attorney, Agent, or Firm* — Locke Lord LLP; Tim Tingkang Xia, Esq.

(57) ABSTRACT

An inductor device includes first, second, third and fourth wire, first and second connector, and eight-shaped inductor structure. First and second wires are disposed in first and second areas. Third wire is disposed in first area and partially overlapped with first wire in a vertical direction, and third wire is coupled to second wire. Fourth wire is disposed in second area and partially overlapped with second wire in the vertical direction, and fourth wire is coupled to first wire. First connector is partially overlapped with first wire or third wire in the vertical direction, and is coupled to inner wire and outer wire of third wire. Second connector is partially overlapped with second wire or fourth wire in the vertical direction, and is coupled to inner and outer wire of fourth wire. Eight-shaped inductor structure is disposed on outer side of third wire and fourth wire.

20 Claims, 5 Drawing Sheets

(58) Field of Classification Search
CPC ..... H01F 2017/004; H01F 17/0013; H01F 27/006; H01F 27/29; H01F 2027/2819
See application file for complete search history.

(56) References Cited

U.S. PATENT DOCUMENTS

| | | | | |
|---|---|---|---|---|
| 10,186,364 | B2 | 1/2019 | Yen et al. | |
| 10,374,571 | B2 | 8/2019 | Wang et al. | |
| 2017/0098500 | A1 | 4/2017 | Yen et al. | |
| 2018/0330872 | A1 | 11/2018 | Yen et al. | |
| 2019/0148479 | A1 | 5/2019 | Yen et al. | |
| 2019/0221350 | A1 | 7/2019 | Yen et al. | |
| 2019/0279809 | A1 | 9/2019 | Yen | |
| 2019/0392980 | A1 | 12/2019 | Yen | |
| 2020/0234864 | A1* | 7/2020 | Elzinga ..... | H03L 7/093 |

FOREIGN PATENT DOCUMENTS

| | | | |
|---|---|---|---|
| CN | 108962563 | A | 12/2018 |
| JP | 2010154517 | A | 7/2010 |
| TW | 201428783 | A | 7/2014 |
| TW | 201703070 | A | 1/2017 |
| TW | I591800 | B | 7/2017 |
| TW | I643216 | B | 12/2018 |
| TW | I643217 | B | 12/2018 |

OTHER PUBLICATIONS

Taiwan Patent Application 108145176 filed Dec. 10, 2019.
China Patent Office, Office Action of the corresponding Chinese application No. 201911129792.1 dated Mar. 29, 2021.
China Patent Office, Office Action of the related Chinese application No. 202010099915.8 dated Mar. 31, 2021.
China Patent Office, Office Action of the related Chinese application No. 202010099595.6 dated Mar. 29, 2021.
China Patent Office, Office Action of the related Chinese application No. 202010099604.1 dated Mar. 29, 2021.
China Patent Office, Office Action of the corresponding Chinese application No. 202010171503.0 dated Mar. 30, 2021.

* cited by examiner

INDUCTOR DEVICE

RELATED APPLICATIONS

This application claims priority to and the benefit of U.S. Provisional Patent Application No. 62/826,286, filed on Mar. 29, 2019, U.S. Provisional Patent Application No. 62/871,263, filed on Jul. 8, 2019, and Taiwan Application Serial Number 108145174, filed on Dec. 10, 2019, the entire contents of which are incorporated herein by reference as if fully set forth below in its entirety and for all applicable purposes.

BACKGROUND

Field of Invention

The present disclosure relates to an electronic device. More particularly, the present disclosure relates to an inductor device.

Description of Related Art

The various types of inductors according to the prior art have their advantages and disadvantages. For example, a spiral inductor has a higher Q value and a larger mutual inductance. However, its mutual inductance value and coupling are both occurred between the coils. For an eight-shaped inductor which has two sets of coils, the coupling between the two sets of coils is relatively low. However, an eight-shaped inductor occupies a larger area in a device. In addition, although a traditional stacked eight-shaped inductor has better symmetry, its inductance value per unit area is lower. Therefore, the scopes of application of the above inductors are limited.

For the foregoing reasons, there is a need to solve the above-mentioned problems by providing an inductor device.

SUMMARY

The foregoing presents a simplified summary of the disclosure in order to provide a basic understanding to the reader. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later.

One objective of the present disclosure is to provide an inductor device to resolve the problems of the prior art. The means of solution are described as follows.

One aspect of the present disclosure is to provide an inductor device. The inductor device includes a first wire, a second wire, a third wire, a fourth wire, a first connector, a second connector, and an eight-shaped inductor structure. The first wire is disposed in a first area. The second wire is disposed in a second area. The third wire is disposed in the first area and at least partially overlapped with the first wire in a vertical direction. The third wire is coupled to the second wire. The fourth wire is disposed in the second area and at least partially overlapped with the second wire in the vertical direction. The fourth wire is coupled to the first wire. The first connector is at least partially overlapped with the first wire or the third wire in the vertical direction, and is coupled to an inner wire and an outer wire of the third wire. The second connector is at least partially overlapped with the second wire or the fourth wire in the vertical direction, and is coupled to an inner wire and an outer wire of the fourth wire. The eight-shaped inductor structure is disposed on the outer side of the third wire and the fourth wire.

Therefore, based on the technical content of the present disclosure, the inductor device adopting the structure according to the embodiment of the present disclosure has a better inductance value per unit area. The inductor device adopting the structure according to the embodiment of the present disclosure has a lower inductance value in the common mode.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

According to the usual mode of operation, various features and elements in the figures have not been drawn to scale, which are drawn to the best way to present specific features and elements related to the disclosure. In addition, among the different figures, the same or similar element symbols refer to similar elements/components.

DESCRIPTION OF THE EMBODIMENTS

To make the contents of the present disclosure more thorough and complete, the following illustrative description is given with regard to the implementation aspects and embodiments of the present disclosure, which is not intended to limit the scope of the present disclosure. The features of the embodiments and the steps of the method and their sequences that constitute and implement the embodiments are described. However, other embodiments may be used to achieve the same or equivalent functions and step sequences.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include the singular. Specifically, as used herein and in the claims, the singular forms "a" and "an" include the plural reference unless the context clearly indicates otherwise.

Figure 1:
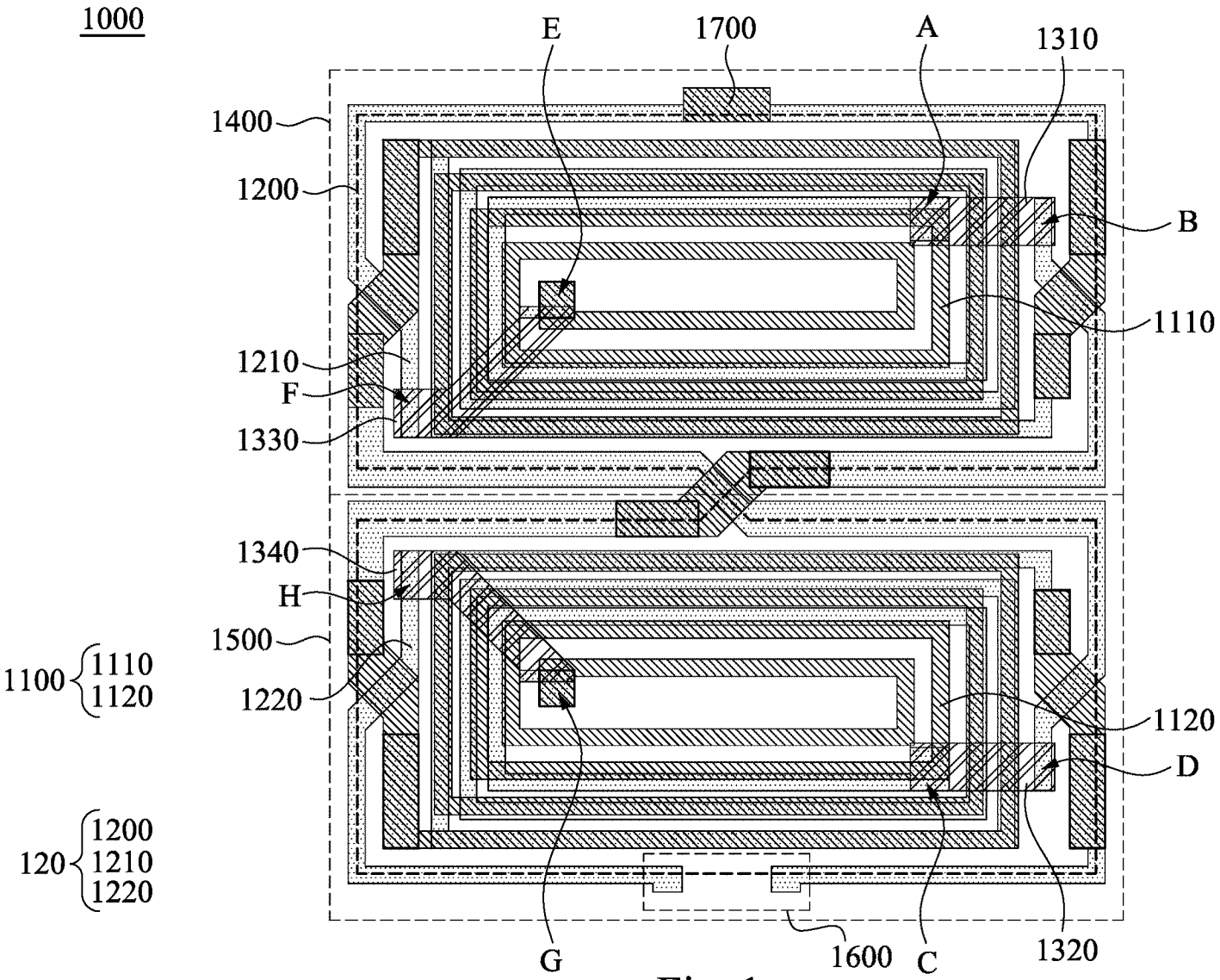
FIG. 1 depicts a schematic diagram of an inductor device according to one embodiment of the present disclosure.

FIG. 1 depicts a schematic diagram of an inductor device 1000 according to one embodiment of the present disclosure. As shown in the figure, the inductor device 1000 includes a first wire 1110, a second wire 1120, a third wire 1210, and a fourth wire 1220, a first connector 1310, a second connector 1320, and an eight-shaped inductor structure 1200. The eight-shaped inductor structure 1200 is an outermost inductor wire (a wire portion shown by a dotted line) of the inductor device 1000. That is to say, the eight-shaped inductor structure 1200 is disposed on an outer side of the third wire 1210 and the fourth wire 1220. The first wire 1110 and the second wire 1120 are partially overlapped with the third wire 1210 and the fourth wire 1220, and the first wire 1110 and the second wire 1120 are disposed inside the eight-shaped inductor structure 1200.

Figure 2:
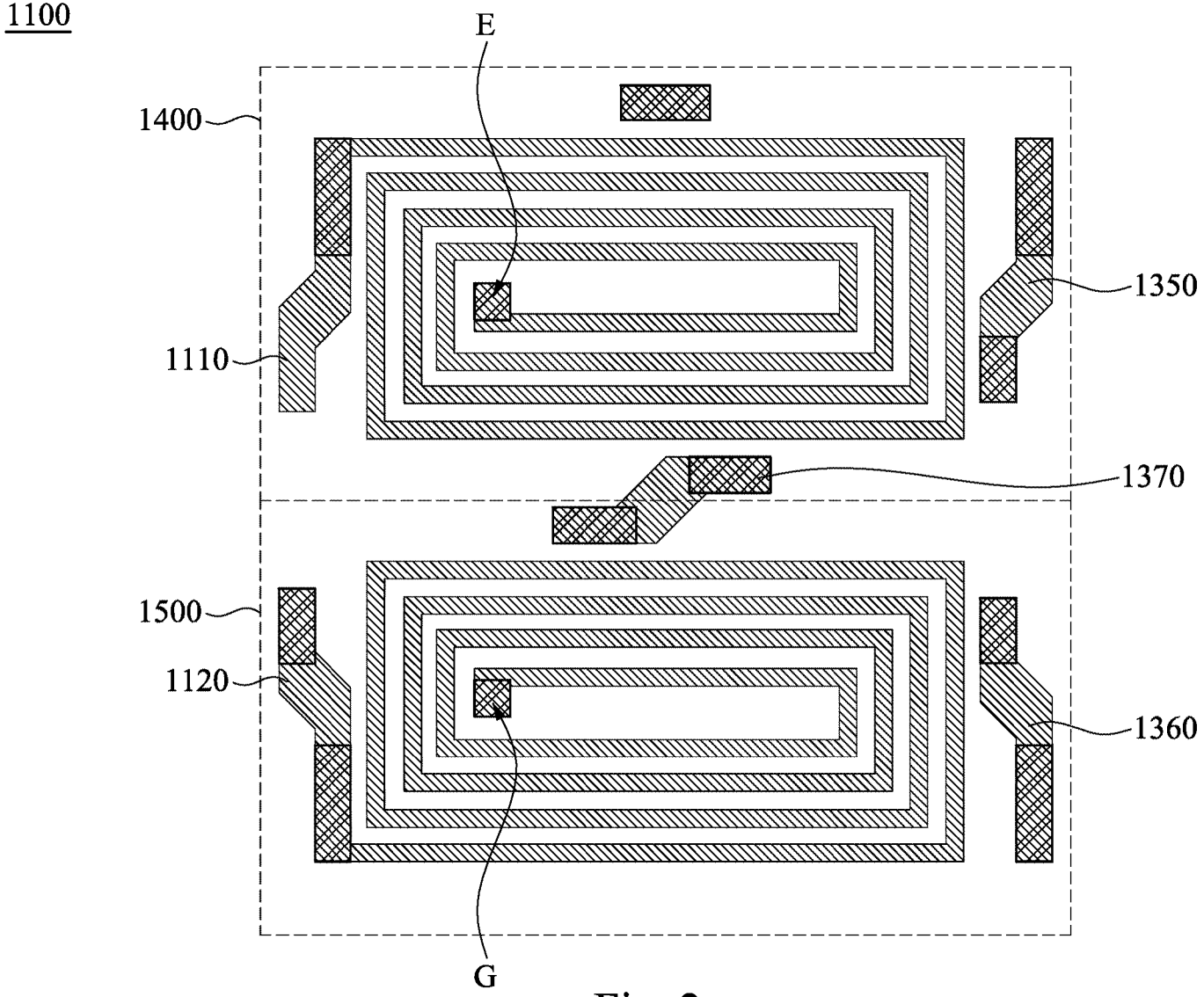
FIG. 2 depicts a schematic diagram of a partial structure of the inductor device shown in FIG. 1 according to one embodiment of the present disclosure.
Figure 3:
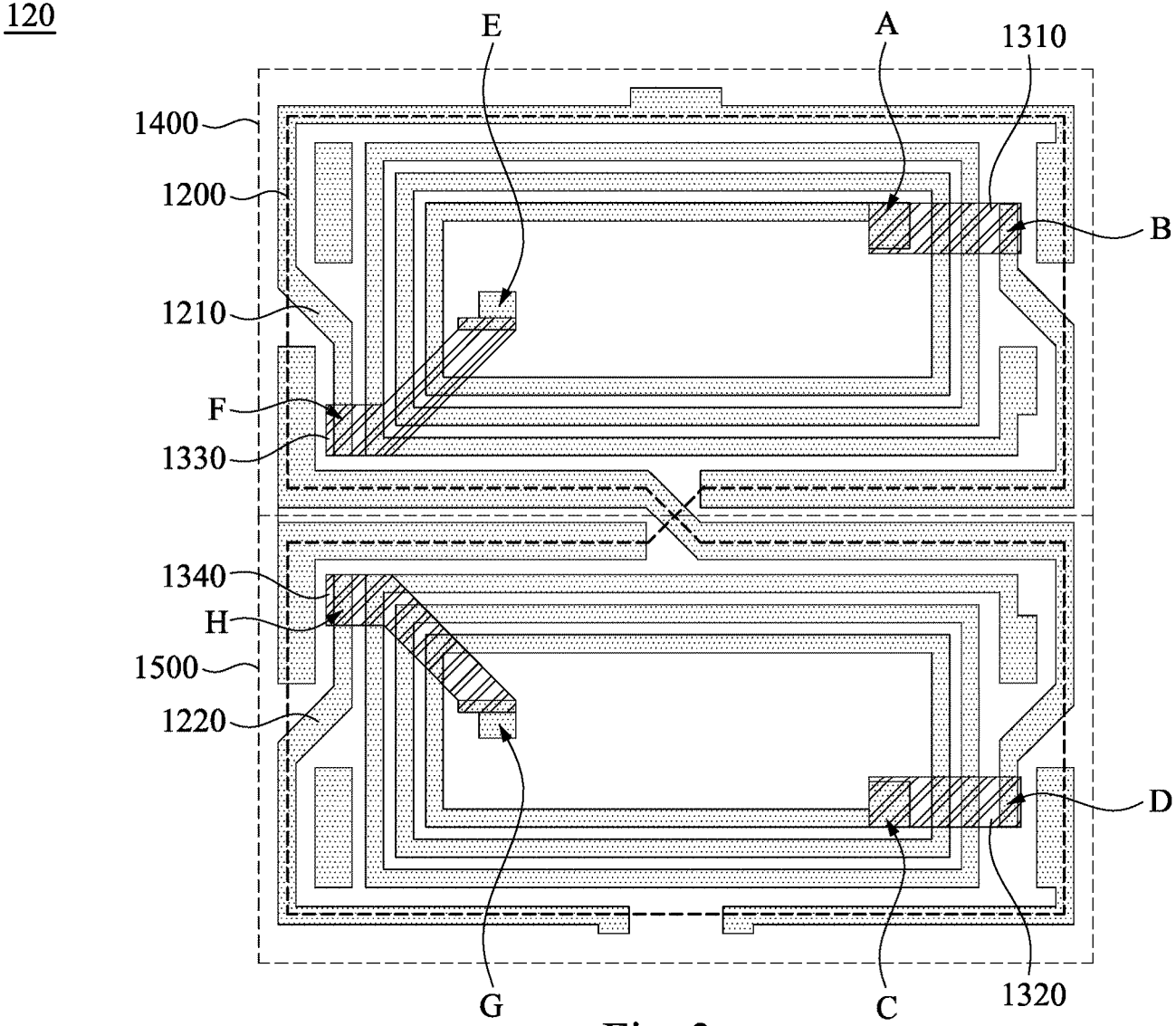
FIG. 3 depicts a schematic diagram of a partial structure of the inductor device shown in FIG. 1 according to one embodiment of the present disclosure.

To facilitate understanding of the present disclosure, the inductor device 1000 shown in FIG. 1 is divided into a partial structure 1100 of the inductor device 1000 shown in FIG. 2 and a partial structure 120 of the inductor device 1000 shown in FIG. 3. The partial structure 120 includes the eight-shaped inductor structure 1200, the third wire 1210, and the fourth wire 1220. A description is provided with reference to FIG. 1 to FIG. 3. The first wire 1110 is disposed in a first area 1400. The second wire 1120 is disposed in a second area 1500. For example, the first area 1400 is located on an upper side of the inductor device 1000, and the second area 1500 is located on a lower side of the inductor device 1000. A detailed structure and connection relationships are provided one by one as follows.

A description is provided with reference to FIG. 1 to FIG. 3. The third wire 1210 is disposed in the first area 1400 and at least partially overlapped with the first wire 1110 in a vertical direction, and the third wire 1210 is coupled to the second wire 1120. That is to say, the third wire 1210 is disposed above or below the first wire 1110 in the vertical direction. The fourth wire 1220 is disposed in the second area 1500 and at least partially overlapped with the second wire 1120 in the vertical direction, and the fourth wire 1220 is coupled to the first wire 1110. That is to say, the fourth wire 1220 is disposed above or below the second wire 1120 in the vertical direction.

In addition, the first connector 1310 is at least partially overlapped with the first wire 1110 in the vertical direction or at least partially overlapped with the third wire 1210 in the vertical direction, and is coupled to an inner wire and an outer wire of the third wire 1210. For example, the first connector 1310 is coupled to the inner wire of the third wire 1210 at a connection point A, and the first connector 1310 is coupled to the outer wire of the third wire 1210 at a connection point B. The second connector 1320 is at least partially overlapped with the second wire 1120 in the vertical direction or at least partially overlapped with the fourth wire 1220 in the vertical direction, and is coupled to an inner wire and an outer wire of the fourth wire 1220. For example, the second connector 1320 is coupled to the inner wire of the fourth wire 1220 at a connection point C, and the second connector 1320 is coupled to the outer wire of the fourth wire 1220 at a connection point D.

A description is provided with reference to FIG. 1 to FIG. 3. The third wire 1210 is coupled with the first wire 1110 on a first side of the first area 1400 in an interlaced manner, and the third wire 1210 is coupled through a connector 1350 on a second side of the first area 1400 in an interlaced manner. That is to say, the outer wire of the third wire 1210 is coupled to the inner wire of the third wire 1210 through the connector 1350. In another embodiment, the first side of the first area 1400 is opposite to the second side of the first area 1400. For example, the first side of the first area 1400 is located on a left side of the figure, and the second side of the first area 1400 is located on a right side of the figure.

In one embodiment, the third wire 1210 is disposed above the first wire 1110 or disposed below the first wire 1110. In other words, the third wire 1210 partially overlaps the first wire 1110 in a top-view direction of the inductor device 1000.

In another embodiment, the first connector 1310 is disposed on the second side (i.e., the right side in the figure) of the first area 1400. In still another embodiment, the inductor device 1000 further includes a third connector 1330. The third connector 1330 is at least partially overlapped with the first wire 1110 in the vertical direction or at least partially overlapped with the third wire 1210 in the vertical direction, and is coupled to first wire 1110 and the third wire 1210. For example, the third connector 1330 is coupled to the first wire 1110 at a connection point E, and the third connector 1330 is coupled to the third wire 1210 at a connection point F. Additionally, the first wire 1110 and the third wire 1210 may be coupled through a vertical connector (i.e., a via) at the connection point E in the top-view direction of the inductor device 1000. In addition to that, the third connector 1330 may be disposed on the first side (i.e., the left side in the figure) of the first area 1400.

A description is provided with reference to FIG. 1 to FIG. 3. The fourth wire 1220 is coupled with the second wire 1120 on a first side of the second area 1500 in an interlaced manner, and the fourth wire 1220 is coupled through a connector 1360 on a second side of the second area 1500 in an interlaced manner. That is to say, the outer wire of the forth wire 1220 is coupled to the inner wire of the forth wire 1220 through the connector 1360. In another embodiment, the first side of the second area 1500 is opposite to the second side of the second area 1500. For example, the first side of the second area 1500 is located on the left side of the figure, and the second side of the second area 1500 is located on the right side of the figure.

In one embodiment, the fourth wire 1220 is disposed above the second wire 1120 or disposed below the second wire 1120. In other words, the fourth wire 1220 partially overlaps the second wire 1210 in the top-view direction of the inductor device 1000.

In another embodiment, the second connector 1320 is disposed on the second side (i.e., the right side in the figure) of the second area 1500. In still another embodiment, the inductor device 1000 further includes a fourth connector 1340. The fourth connector 1340 is at least partially overlapped with the second wire 1120 in the vertical direction or at least partially overlapped with the fourth wire 1220 in the vertical direction, and is coupled to the second wire 1120 and the fourth wire 1220. For example, the fourth connector 1340 is coupled to the second wire 1120 at a connection point G, and the fourth connector 1340 is coupled to the fourth wire 1220 at a connection point H. In addition, the second wire 1120 and the fourth wire 1220 may be coupled through a vertical connector (i.e., a via) at the connection point H in the top-view direction of the inductor device 1000. Additionally, the fourth connector 1340 is disposed on the first side (i.e., the left side in the figure) of the second area 1500.

A description is provided with reference to FIG. 1. The third wire 1210 and the fourth wire 1220 are coupled at a junction of the first area 1400 and the second area 1500 through a connector 1370 in an interlaced manner. In addition to that, the inductor device 1000 further includes an input terminal 1600. The input terminal 1600 is disposed on one side (i.e., the lower side in the figure) of the second area

1500 opposite to the junction. In addition, the inductor device 1000 further includes a center-tapped terminal 1700. The center-tapped terminal 1700 is disposed on one side (i.e., the upper side in the figure) of the first area 1400 opposite to the junction.

A description is provided with reference to FIG. 2. The first wire 1110 and the second wire 1120 are located on a same layer. In one embodiment, each of the first wire 1110 and the second wire 1120 may be but not limited to a spiral coil. The first wire 1110 and the second wire 1120 are not limited to the structures shown in FIG. 2, and shapes and numbers of windings of the first wire 1110 and the second wire 1120 may be configured depending on practical needs.

A description is provided with reference to FIG. 3. The third wire 1210 and the fourth wire 1220 are located on a same layer. In one embodiment, the third wire 1210 and the fourth wire 1220 are not limited to the structures shown in FIG. 3, and shapes and numbers of windings of the third wire 1210 and the fourth wire 1220 may be configured depending on practical needs. Additionally, a description is provided with reference to FIG. 1 to FIG. 3. Since the third wire 1210 is disposed above or below the first wire 1110 and the first wire 1110 and the second wire 1120 are located on the same layer, the third wire 1210 is located on a different layer from the second wire 1120. In addition to that, since the fourth wire 1220 is disposed above or below the second wire 1120 and the first wire 1110 and the second wire 1120 are located on the same layer, the fourth wire 1220 is located on a different layer from the first wire 1110.

Figure 4:
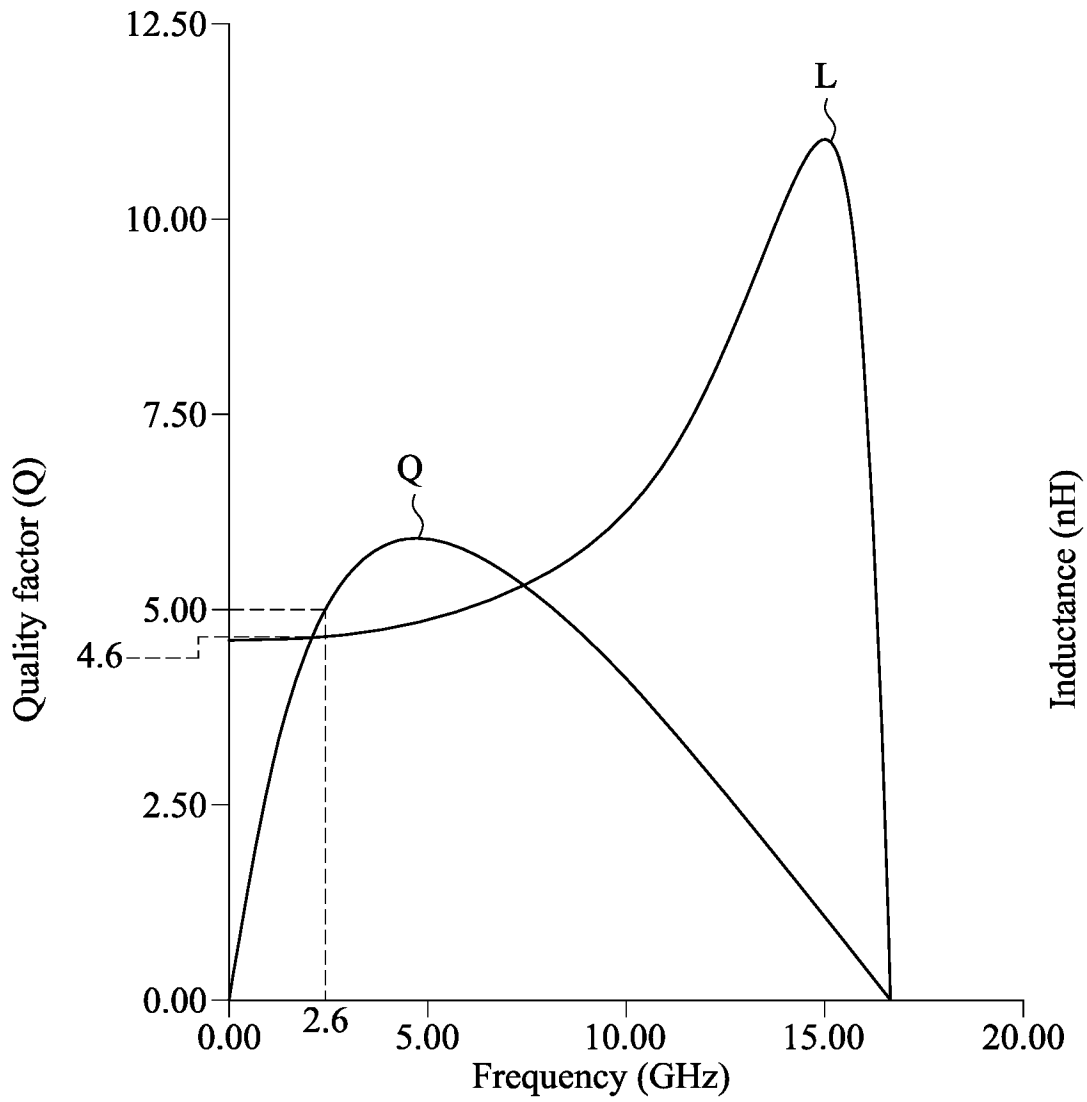
FIG. 4 depicts a schematic diagram of experimental data of an inductor device according to one embodiment of the present disclosure.

FIG. 4 depicts a schematic diagram of experimental data of the inductor device 1000 according to one embodiment of the present disclosure. As shown in the figure, with the structural configuration according to the present disclosure in the differential mod, the experimental curve of the quality factor is Q and the experimental curve of the inductance value is L. As can be seen from the figure, the inductor device 1000 adopting the structure of the present disclosure has a better inductance value per unit area. For example, the inductor device 1000 has an inductance value that can reach about 4.6 nH and a quality factor (Q) of about 5 at a frequency of 2.6 GHz within an area of 90 um*90 um.

Figure 5:
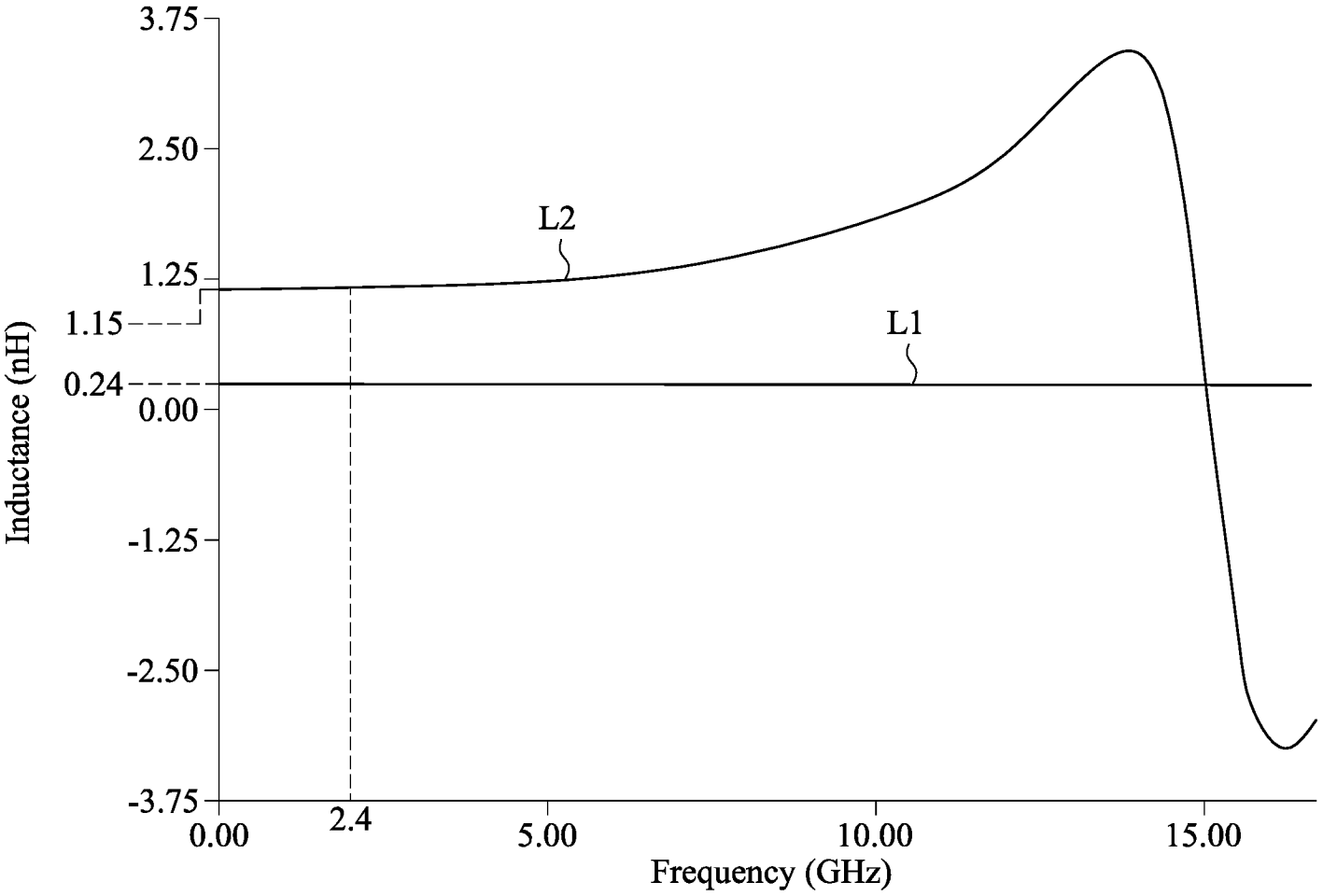
FIG. 5 depicts a schematic diagram of experimental data of an inductor device according to one embodiment of the present disclosure.

FIG. 5 depicts a schematic diagram of experimental data of the inductor device 1000 according to one embodiment of the present disclosure in the common mode. As shown in the figure, the experimental curve of the inductance value of the inductor device adopting the structural configuration of the present disclosure is L1, and the experimental curve of the inductance value of the inductor device not adopting the structural configuration of the present disclosure is L2. As can be seen from the figure, the inductor device 1000 adopting the structure of the present disclosure has a lower inductance value in the common mode. For example, at a frequency of about 2.4 GHz, the inductance value of the inductor device not adopting the structural configuration of the present disclosure is about 1.15 nH, but the inductance value of the inductor device 1000 according to the present disclosure is only about 0.24H. As a result, the inductor device 1000 according to the present disclosure can improve the linearity of third-order intermodulation distortion (IMD3)/high third-order intercept point (IIP3).

It can be understood from the embodiments of the present disclosure that application of the present disclosure has the following advantages. The inductor device adopting the structure according to the embodiment of the present disclosure has a better inductance value per unit area. The inductor device adopting the structure according to the embodiment of the present disclosure has a lower inductance value in the common mode. As a result, the inductor device according to the present disclosure can improve the linearity of third-order intermodulation distortion/high third-order intercept point.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An inductor device, comprising:

a first wire disposed in a first area;

a second wire disposed in a second area;

a third wire disposed in the first area, wherein a plurality portions of the third wire overlap with a plurality portions of the first wire in a vertical direction and are parallel in a horizontal direction, and the vertical direction is perpendicular to a layer where the first wire is located, wherein the third wire is coupled to the second wire;

a fourth wire disposed in the second area, wherein a plurality portions of the fourth wire overlap with a plurality portions of the second wire in the vertical direction and are parallel in the horizontal direction, wherein the fourth wire is coupled to the first wire;

a first connector being at least partially overlapped with the first wire or the third wire in the vertical direction, and being coupled to an inner wire and an outer wire of the third wire;

a second connector being at least partially overlapped with the second wire or the fourth wire in the vertical direction, and being coupled to an inner wire and an outer wire of the fourth wire; and an eight-shaped inductor structure disposed on an outer side of the third wire and the fourth wire.

2. The inductor device of claim 1, wherein the third wire is coupled with the first wire on a first side of the first area in an interlaced manner, and the third wire is coupled through a connector on a second side of the first area in an interlaced manner.

3. The inductor device of claim 2, wherein the first side of the first area is opposite to the second side of the first area.

4. The inductor device of claim 1, wherein the third wire is disposed above the first wire or below the first wire.

5. The inductor device of claim 2, wherein the first connector is disposed on the second side of the first area.

6. The inductor device of claim 5, further comprising:

a third connector being at least partially overlapped with the first wire or the third wire in the vertical direction, and being coupled to the first wire and the third wire.

7. The inductor device of claim 6, wherein the third connector is disposed on the first side of the first area.

8. The inductor device of claim 1, wherein the fourth wire is coupled with the second wire on a first side of the second area in an interlaced manner, and the fourth wire is coupled through a connector on a second side of the second area in an interlaced manner.

9. The inductor device of claim 8, wherein the first side of the second area is opposite to the second side of the second area.

10. The inductor device of claim 1, wherein the fourth wire is disposed above the second wire or below the second wire.

11. The inductor device of claim 8, wherein the second connector is disposed on the second side of the second area.

12. The inductor device of claim 11, further comprising:

a fourth connector being at least partially overlapped with the second wire or the fourth wire in the vertical direction, and being coupled to the second wire and the fourth wire.

13. The inductor device of claim 12, wherein the fourth connector is disposed on the first side of the second area.

14. The inductor device of claim 1, wherein the third wire and the fourth wire are coupled at a junction of the first area and the second area in an interlaced manner.

15. The inductor device of claim 14, further comprising:

an input terminal disposed on one side of the second area opposite to the junction.

16. The inductor device of claim 14, further comprising:

a center-tapped terminal disposed on one side of the first area opposite to the junction.

17. The inductor device of claim 1, wherein the first wire and the second wire are located on a same layer.

18. The inductor device of claim 1, wherein the third wire and the fourth wire are located on a same layer.

19. The inductor device of claim 1, wherein the second wire is located on a different layer from the third wire.

20. The inductor device of claim 1, wherein the first wire is located on a different layer from the fourth wire.

* * * * *